US009982951B2

(12) United States Patent
Ho et al.

(10) Patent No.: US 9,982,951 B2
(45) Date of Patent: May 29, 2018

(54) MAIN HEAT EXCHANGER AND A PROCESS FOR COOLING A TUBE SIDE STREAM

(75) Inventors: Siew-Mung Patricia Ho, Como (AU); Derek William Hodges, Dianella (AU); Christiane Kerber, Poecking (DE); Manfred Steinbauer, Raisting (DE); Markus Hammerdinger, Tacherting (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 736 days.

(21) Appl. No.: 13/637,711

(22) PCT Filed: Mar. 31, 2011

(86) PCT No.: PCT/AU2011/000373

§ 371 (c)(1),
(2), (4) Date: Dec. 6, 2012

(87) PCT Pub. No.: WO2011/120096

PCT Pub. Date: Oct. 6, 2011

(65) Prior Publication Data

US 2013/0068431 A1 Mar. 21, 2013

(30) Foreign Application Priority Data

Mar. 31, 2010 (AU) ..... 2010901347

(51) Int. Cl.
*F25J 1/00* (2006.01)
*F28F 9/00* (2006.01)
(Continued)

(52) U.S. Cl.
CPC ..... *F28F 9/001* (2013.01); *F25J 1/0022* (2013.01); *F25J 1/0055* (2013.01); *F25J 1/0244* (2013.01); *F25J 1/0262* (2013.01); *F25J 1/0267* (2013.01); *F25J 5/002* (2013.01); *F28D 7/0066* (2013.01); *F28D 7/024* (2013.01); *F28F 27/02* (2013.01); *F25J 2210/06* (2013.01); *F25J 2220/62* (2013.01); *F25J 2290/32* (2013.01)

(58) Field of Classification Search
CPC ..... F25J 1/0022; F25J 1/0047; F25J 1/0052; F25J 1/0055; F25J 1/0211; F25J 1/0214;
(Continued)

(56) References Cited

U.S. PATENT DOCUMENTS 2,241,186 A 5/1941 Coons
3,450,105 A * 6/1969 Osburn ..... F28F 27/02 122/451 R (Continued)

FOREIGN PATENT DOCUMENTS

DE 102007036181 * 2/2008 ..... B01D 5/0006
JP S5577697 * 6/1980
WO 03/012356 A1 2/2003

OTHER PUBLICATIONS

DE102007036181TRANS (English Translation), Feb. 2008.*

(Continued)

*Primary Examiner* — Len Tran
*Assistant Examiner* — Eric Ruppert
(74) *Attorney, Agent, or Firm* — Millen White Zelano & Branigan, PC

(57) ABSTRACT

A process for cooling a tube side stream in a main heat exchanger is described. The process comprises: a) supplying a first mass flow of a tube side stream to a first zone of individual tubes in the tube bundle; b) supplying a second mass flow of the tube side stream to a second zone of individual tubes in the tube bundle, the second zone being offset from the first zone; c) supplying a refrigerant stream on the shell side for cooling the first and second mass flows; d) removing the evaporated refrigerant stream from the warm end of the main heat exchanger; and, e) adjusting the first mass flow of the tube side stream relative to the second mass flow of the tube side stream to maximise the temperature of the removed evaporated refrigerant stream.

36 Claims, 3 Drawing Sheets

(51) Int. Cl.

| | |
|---|---|
| ***F25J 1/02*** | (2006.01) |
| ***F28D 7/00*** | (2006.01) |
| ***F28D 7/02*** | (2006.01) |
| ***F28F 27/02*** | (2006.01) |
| ***F25J 5/00*** | (2006.01) |

(58) Field of Classification Search

CPC ..... F25J 1/0215; F25J 1/0216; F25J 1/0217; F25J 1/0218; F25J 1/0219; F25J 1/0244; F25J 1/0252; F25J 1/0254; F25J 2290/02; F25J 2290/10; F25J 2290/12

USPC ..... 62/611–613, 657

See application file for complete search history.

(56) References Cited

U.S. PATENT DOCUMENTS

| | | | | |
|---|---|---|---|---|
| 4,313,491 | A | 2/1982 | Molitor | |
| 4,529,032 | A | 7/1985 | Molitor | |
| 4,601,328 | A | 7/1986 | Tsaka et al. | |
| 4,809,154 | A * | 2/1989 | Newton | 700/28 |
| 5,651,270 | A | 7/1997 | Low et al. | |
| 5,791,160 | A * | 8/1998 | Mandler et al. | 62/611 |
| 6,189,605 | B1 | 2/2001 | Lameris | |
| 6,272,882 | B1 * | 8/2001 | Hodges et al. | 62/613 |
| 6,725,688 | B2 * | 4/2004 | Elion et al. | 62/612 |
| 7,661,460 | B1 | 2/2010 | Cowans et al. | |
| 2004/0255615 | A1 * | 12/2004 | Hupkes et al. | 62/606 |
| 2006/0021377 | A1 * | 2/2006 | Lee et al. | 62/612 |
| 2006/0213223 | A1 * | 9/2006 | Wilding et al. | 62/613 |
| 2008/0296004 | A1 * | 12/2008 | Steinbauer et al. | 165/163 |
| 2009/0025422 | A1 * | 1/2009 | Sicinski et al. | 62/613 |
| 2009/0301130 | A1 * | 12/2009 | Schonberger et al. | 62/614 |

OTHER PUBLICATIONS

Sasaki, JPS5577697TRANS (English Translation), Jun. 1980.*

International Search Report, dated Jun. 14, 2011, issued in corresponding PCT/AU2011/000373.

* cited by examiner

Figure 1: Prior Art

MAIN HEAT EXCHANGER AND A PROCESS FOR COOLING A TUBE SIDE STREAM

FIELD OF THE INVENTION

The present invention relates to a process for cooling a tube side stream in a main heat exchanger. The present invention further relates to a main heat exchanger for thermally processing a tube side stream. The present invention relates particularly though not exclusively to a process and a main heat exchanger for liquefying a gaseous, methane-rich feed to obtain a liquefied product known as "liquefied natural gas" or "LNG".

BACKGROUND TO THE INVENTION

A typical liquefaction process is described in U.S. Pat. No. 6,272,882 in which the gaseous, methane-rich feed is supplied at elevated pressure to a first tube side of a main heat exchanger at its warm end. The gaseous, methane-rich feed is cooled, liquefied and sub-cooled against evaporating refrigerant to get a liquefied stream. The liquefied stream is removed from the main heat exchanger at its cold end and passed to storage as liquefied product. Evaporated refrigerant is removed from the shell side of the main heat exchanger at its warm end. The evaporated refrigerant is compressed in at least one refrigerant compressor to get high-pressure refrigerant. The high-pressure refrigerant is partly condensed and the partly condensed refrigerant is separated into a liquid heavy refrigerant fraction and a gaseous light refrigerant fraction. The heavy refrigerant fraction is sub-cooled in a second tube side of the main heat exchanger to get a sub-cooled heavy refrigerant stream. The heavy refrigerant stream is introduced at reduced pressure into the shell side of the main heat exchanger at an intermediate point, with the heavy refrigerant stream being allowed to evaporate in the shell side of the main heat exchanger. At least part of the light refrigerant fraction is cooled, liquefied and sub-cooled in a third tube side of the main heat exchanger to get a sub-cooled light refrigerant stream. This light refrigerant stream is introduced at reduced pressure into the shell side of the main heat exchanger at its cold end, and the light refrigerant stream is allowed to evaporate in the shell side.

It is apparent from the description provided above that the tube side of the main heat exchanger is required to handle three streams, namely: i) a gaseous, methane-rich feed which enters the warm end of the first tube side as a gas at elevated pressure, condenses as it travels through the first tube side, and leaves the cold end of the first tube side as a sub-cooled liquefied stream; ii) a heavy refrigerant fraction which enters the warm end of the second tube side as a liquid, is sub-cooled as it travels through the second tube side, and leaves the cold end of the second tube side as a sub-cooled heavy refrigerant stream; and, iii) a least a part of the light refrigerant fraction which enters the warm end of the third tube side as a vapour, is cooled, liquefied and sub-cooled as it travels through the third tube side, and leaves the cold end of the third tube side as a sub-cooled light refrigerant stream.

At the same time, the shell side of the main heat exchanger is required to handle: a) a heavy refrigerant stream which enters the shell side at an intermediate location (at a location referred to in the art as the "top of the warm tube bundle"), and which is evaporated within the shell side before being removed as a gas from the shell side at its warm end; and, b) a light refrigerant stream which enters the shell side at reduced pressure at its cold end (at a location referred to in the art as the "top of the cold tube bundle"), and which is evaporated within the shell side before being removed as a gas from the shell side at its warm end.

Thus, in order to operate in the type of liquefaction process described in U.S. Pat. No. 6,272,882, the main heat exchanger must be capable of handling both single and two phase streams, all of which condense at different temperatures, with multiple tube-side and shell-side streams being accommodated in the one exchanger. The main heat exchanger must also be capable of handling streams having a broad range of temperatures and pressures. For this reason, the main heat exchanger used in liquefaction plants around the world is a "coil-wound" or "spiral-wound" heat exchanger.

In such coil-wound heat exchangers, the tubes for each of the individual streams are distributed evenly in multiple layers which are wound around a central pipe or mandrel to form a "bundle". Each of the plurality of layers of tubes may comprise hundreds of evenly sized tubes with an even distribution of each of the first, second and third tube side fluids in each layer in proportion to their flow ratios. The efficiency of the main heat exchanger relies on heat transfer between the shell side and the tube side in each of these multiple layers being as balanced as possible—both radially across the bundle and axially along the length of the bundle.

As spiral-wound heat exchangers become larger to perform increased duties, it becomes increasingly difficult to distribute the shell side fluids evenly. This is partly due to the fact that on the shell side, the composition of the heavy and light refrigerant streams change continuously along the length of the main heat exchanger as the light components boils off first. As a consequence, heat transfer between the shell side and each of the first, second and third tube sides may become uneven across the layers within the bundle. This uneven distribution of temperature in the shell side fluids leads to unevenness in the temperature in portions of each of the tube side fluids at the cold ends of the bundle from each layer of tubes in the bundle, and for the shell-side fluid exiting at the warm end.

When the system is in balance, the temperature difference between the tube sides and the shell side remains relatively constant but narrow along the majority of the length of the main heat exchanger. When the system is out of balance, the close temperature differential between the tube sides and the shell side can become "pinched" at locations where a very small or no temperature differential exists at all. Such pinching causes a drop in efficiency of the main heat exchanger. A consequential drop in efficiency is also experienced in the associated mixed refrigerant compression circuit which receives the fluid exiting the warm end of the shell side of the main heat exchanger. If the main heat exchanger is working correctly, the fluid exiting the warm end of the shell side is a gas. When the main heat exchanger is out of balance, the fluid exiting the warm end of the shell side may comprise a two phase mixture of gas and liquid. Any liquid present represents a significant loss of efficiency and must also be removed to avoid potential damage to the downstream refrigerant compression circuit.

The present invention provides a process and apparatus for improving the efficiency of a main heat exchanger by overcoming at least one of the problems identified above.

SUMMARY OF THE INVENTION

According to a first aspect of the present invention there is provided a process for cooling a tube side stream in a main heat exchanger having a warm end and a cold end, the main heat exchanger comprising a wall defining a shell side within which a coil-wound tube bundle is arranged around a central mandrel, the process comprising the steps of:

a) supplying a first mass flow of a tube side stream to the warm end of a first zone of individual tubes in the tube bundle via a first nozzle;

b) supplying a second mass flow of the tube side stream to the warm end of a second zone of individual tubes in the tube bundle via a second nozzle, the second zone being offset from the first zone along a radius extending from the central mandrel to the wall of the main heat exchanger;

c) supplying a refrigerant stream on the shell side for cooling the first and second mass flows to form an evaporated refrigerant stream;

d) removing the evaporated refrigerant stream from the warm end of the main heat exchanger; and, e) adjusting the first mass flow of the tube side stream relative to the second mass flow of the tube side stream to maximise the temperature of the evaporated refrigerant stream removed in step d).

In one form, step e) comprises equalising the temperature of the first mass flow of the tube side stream at a first axial location relative to the length of the mandrel with the temperature of the second mass flow of the tube side stream at said first axial location by adjusting the mass flow supplied to one or both of the first and second nozzles.

In one form, a first temperature sensor generates a first signal indicative of the temperature of the first mass flow and a second temperature sensor generates a second signal indicative of the temperature of the second mass flow and step e) comprises using a controller to adjust the first mass flow of the tube side stream relative to the second mass flow of the tube side stream to equalise the first signal with the second signal. In one form, the first axial location is at or adjacent to the cold end of the main heat exchanger. In one form, the first zone is an inner zone of the tube bundle and the second zone is an outer zone of the tube bundle. In one form, wherein the mass flow through the first nozzle is controllably adjusted using a first valve and the mass flow through the second nozzle is controllably adjusted using a second valve. In one form, one or both of the first and second valves is external to the main heat exchanger. In one form, one or both of the first and second valves is a fail-safe open low pressure drop valve. In one form, one or both of the first and second valves is located at one or both of the warm end and the cold end of the tube side stream.

In one form, the first nozzle supplies the tube fluid to the first zone via a first tube sheet and the second nozzle supplies the tube side fluid to the second zone via a second tube sheet. In one form, the tube bundle comprises a warm tube bundle arranged towards the warm end of the main heat exchanger, and a cold tube bundle arranged towards the cold end of the main heat exchanger, each of the warm tube bundle and the cold tube bundle having a warm end and a cold end and the first location is at or adjacent to the cold end of the warm tube bundle. In one form, the tube side stream is a first tube side stream which enters the warm end of the warm tube bundle as a liquid and exits the cold end of the cold tube bundle as a sub-cooled liquid.

In one form, the first tube side stream enters the warm end of the warm tube bundle as a gaseous, methane-rich feed which has been liquefied by the time it passes from the warm end of the warm tube bundle into the warm end of the cold tube bundle. In one form, the first tube side stream enters the warm end of the cold tube bundle as a liquid and exits the cold end of the cold tube bundle as a sub-cooled liquid. In one form, wherein the sub-cooled liquid is removed from the cold end of the cold tube bundle of the main heat exchanger before being directed to storage. In one form, the first tube side stream exchanges heat with a predominately liquid light refrigerant stream which is progressively boiled off on the shell side of the cold tube bundle. In one form, evaporated refrigerant removed from the warm end of the shell side of the main heat exchanger is fed to first and second refrigerant compressors in which the evaporated refrigerant is compressed to form a high pressure refrigerant stream. In one form, the high pressure refrigerant stream is directed to a heat exchanger in which it is cooled so as to produce a partly-condensed refrigerant stream which is then directed in a separator to separate out a heavy refrigerant fraction in liquid form and a light refrigerant fraction in gaseous form.

In one form, the heavy refrigerant fraction becomes a second tube side stream which is supplied at the warm end of the warm tube bundle as a liquid and exits at the cold end of the warm tube bundle as a sub-cooled heavy refrigerant stream in liquid form. In one form, the sub-cooled heavy refrigerant stream removed at the cold end of the warm tube bundle is expanded across a first expansion device to form a reduced pressure heavy refrigerant stream that is then introduced into the shell side of the main heat exchanger at a location intermediate between the cold end of the warm tube bundle and the warm end of the cold tube bundle, and wherein said reduced pressure heavy refrigerant stream is allowed to evaporate in the shell side, thereby cooling the fluids in the first, second and third tube side streams as they pass through the warm tube bundle. In one form, part of the light refrigerant fraction from the separator becomes a third tube side stream which is introduced into the warm end of the warm tube bundle as a gas and exits at the cold end of the cold tube bundle as a sub-cooled liquid. In one form, the third tube side stream is cooled from a gas to a liquid as it passes through the warm tube bundle and is cooled from a liquid to a sub-cooled liquid as it passes through the cool bundle.

In one form, the sub-cooled light refrigerant stream removed from the cold end of the cold tube bundle is expanded through a second expansion device to cause a reduction in pressure and produce a reduced pressure light refrigerant stream. In one form, the reduced pressure light refrigerant stream is introduced into the shell side of the main heat exchanger at its cold end, and wherein said reduced pressure light refrigerant stream is allowed to evaporate in the shell side, thereby cooling the fluids in the first and third tube side streams as they travel through the cold tube bundle as well as providing cooling to the fluids in the first, second and third tube side streams as they travel through the warm tube bundle.

According to one aspect of the present invention there is provided a main heat exchanger for liquefying a tube side stream, the main heat exchanger having a warm end and a cold end in use, the main heat exchanger comprising:

a wall defining a shell side within which is arranged a coil-wound tube bundle;

a first nozzle for supplying a first mass flow of a tube side stream to the warm end of a first zone of individual tubes in the tube bundle via a first nozzle;

a second nozzle for supplying a second mass flow of the tube side stream to the warm end of a second zone of individual tubes in the tube bundle via a second nozzle, the second zone being offset from the first zone along a radius extending from the central mandrel to the wall of the main heat exchanger;

a distributor for supplying a refrigerant stream on the shell side for cooling the first and second mass flows to form an evaporated refrigerant stream;

means for removing the evaporated refrigerant stream from the warm end of the main heat exchanger; and, a controller for adjusting the first mass flow of the tube side stream supplied by the first nozzle relative to the second mass flow of the tube side stream supplied by the second nozzle to maximise the temperature of the evaporated refrigerant stream as measured by a temperature sensor.

In one form, the controller adjusts the mass flow supplied to one or both of the first and second nozzles to equalise the temperature of the first mass flow of the tube side stream at a first axial location relative to the length of the mandrel with the temperature of the second mass flow of the tube side stream at said first axial location. In one form, a first temperature sensor generates a first signal indicative of the temperature of the first mass flow and a second temperature sensor generates a second signal indicative of the temperature of the second mass flow and the controller adjusts the first mass flow of the tube side stream relative to the second mass flow of the tube side stream to equalise the first signal with the second signal. In one form, the first axial location is at or adjacent to the cold end of the main heat exchanger. In one form, the first zone is an inner zone of the tube bundle and the second zone is an outer zone of the tube bundle. In one form, the mass flow through the first nozzle is controllably adjusted using a first valve and the mass flow through the second nozzle is controllably adjusted using a second valve. In one form, one or both of the first and second valves is external to the main heat exchanger. In one form, one or both of the first and second valves is a fail-safe open low pressure drop valve. In one form, one or both of the first and second valves is located at one or both of the warm end and the cold end of the tube side stream. In one form, the first nozzle supplies the tube fluid to the first zone via a first tube sheet and the second nozzle supplies the tube side fluid to the second zone via a second tube sheet. In one form, the tube bundle comprises a warm tube bundle arranged towards the warm end of the main heat exchanger, and a cold tube bundle arranged towards the cold end of the main heat exchanger, each of the warm tube bundle and the cold tube bundle having a warm end and a cold end and the first location is at or adjacent to the cold end of the warm tube bundle.

According to a third aspect of the present invention there is provided a process for cooling a tube side stream in a main heat exchanger substantially as herein described with reference to and as illustrated in FIGS. 2 and 3.

According to a fourth aspect of the present invention there is provided a main heat exchanger process for liquefying a tube side stream substantially as herein described with reference to and as illustrated in FIGS. 2 and 3.

DESCRIPTION OF THE DRAWINGS

In order to facilitate a more detailed understanding of the nature of the invention embodiments of the present invention will now be described in detail, by way of example only, with reference to the accompanying drawings, in which.

DESCRIPTION OF EMBODIMENTS OF THE INVENTION

Figure 1:
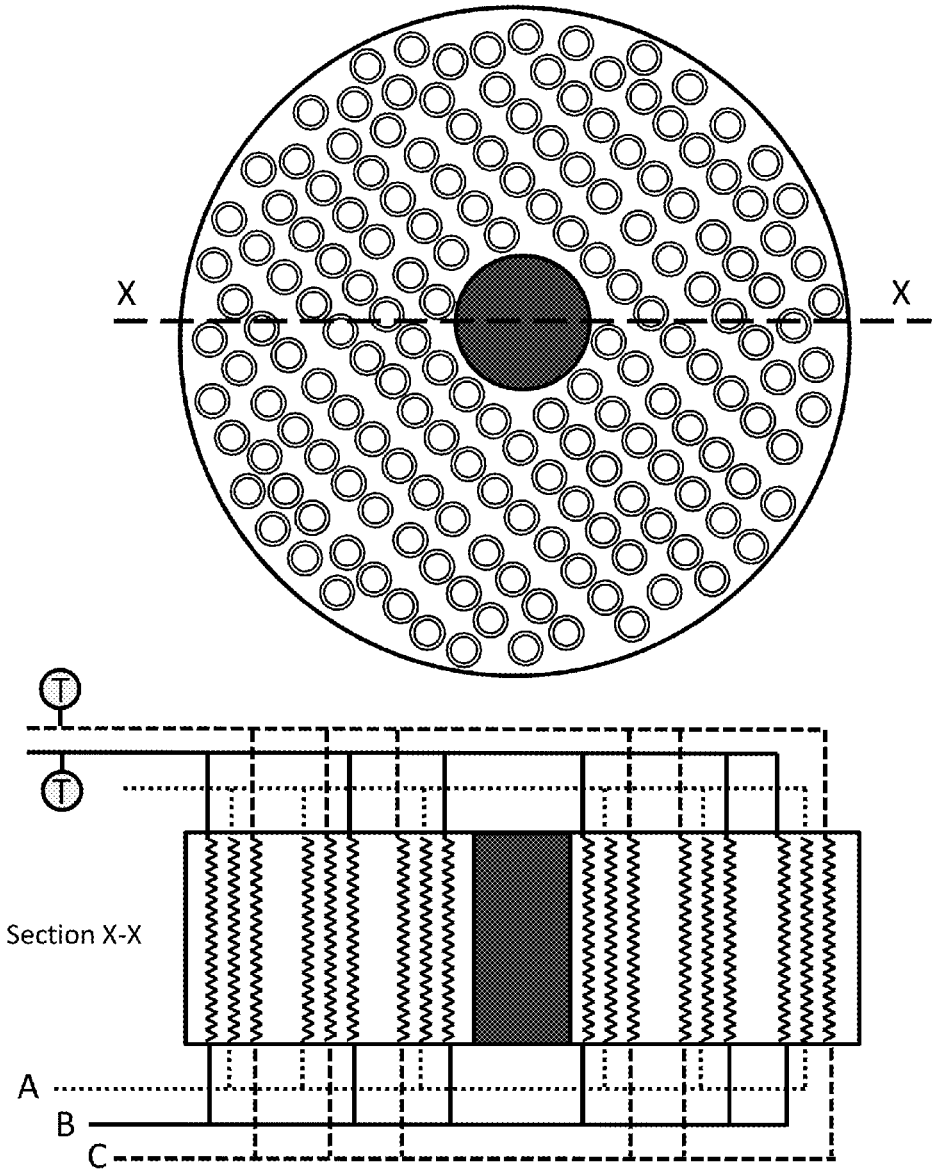
FIG. 1 shows schematically the distribution of flows to each layer of a prior art spiral wound main heat exchanger.

Particular embodiments of the process and apparatus of the present invention are now described, with particular reference to a plant for liquefying a gaseous, methane-rich feed gas in the form of natural gas in a main heat exchanger to produced liquefied natural gas, by way of example only. The present invention is equally applicable to a main heat exchanger used for other applications such as the production of ethylene or other process requiring on two tube side streams instead of the three tube side streams described in detail below. The terminology used herein is for the purpose of describing particular embodiments only, and is not intended to limit the scope of the present invention. Unless defined otherwise, all technical and scientific terms used herein have the same meanings as commonly understood by one of ordinary skill in the art to which this invention belongs. In the drawings, it should be understood that like reference numbers refer to like parts.

Using a typical prior art spiral wound main heat exchanger such as the one illustrated schematically in FIG. 1, the tube bundle is spiral wound whereby each tube side stream is introduced to the tube bundle via one or more flow control nozzles arranged to evenly distribute the mass flow of any given type of tube side stream into a plurality of individual tubes arranged randomly yet evenly across the full radius of the tube bundle when viewed in cross-section. More specifically, each nozzle causes the mass flow of each tube side stream to be distributed evenly between each layer of individual tubes within the tube bundle. When the tube bundle is wound so as to have a plurality of layers of individual tubes, the mass flow of any given tube side stream from any given nozzle is split evenly across each of the plurality of layers. The net result is that every nozzle distributes an even amount of its mass flow across any given cross-section taken through the tube bundle—axially and radially. In an analogous manner, the mass flow of light refrigerant entering the shell side at the cold end of a cold tube bundle in the main heat exchanger is distributed across the shell side using a first distributor (not shown), and the mass flow of heavy refrigerant entering the shell side at the cold end of a warm tube bundle is distributed across the shell side using a second distributor (not shown). This prior art arrangement is advocated for use in maintaining as even a heat balance across the main heat exchanger as possible at all times.

The present invention is based in part on the realisation that it is difficult to fix any imbalance in the temperature, composition or mass flow rate distribution of the reduced pressure light and heavy refrigerant streams on the shell side of the main heat exchanger. Whilst the vapour phase present is capable of mixing in the radial direction to some degree, the liquid phase present on the shell side does not to any significant extent with the result that any imbalance in temperature across the tube bundle cannot be corrected by making adjustments on the shell side. Instead, the Applicants have realised that an improvement in efficiency can be achieved by adjusting the mass flow of at least one of the tube side streams to compensate for any imbalance on the shell side. The present invention is further based in part on a realisation that this traditional method of construction of a spiral would heat exchanger provides no mechanism to address problems which arise in the event of an imbalance of cooling on the shell side of the main heat exchanger.

Using the process of the present invention, the tube bundle is wound in such a way that any given nozzle supplies a tube side stream into only one zone of the tube bundle, each zone comprising a plurality of layers of individual tubes, so that the mass flow of that tube side stream to each zone within the tube bundle can be separately controlled. By providing this level of control, the mass flow of each tube side stream to each zone of the bundle can be adjusted to compensate for an uneven distribution of cooling on the shell side, wherever and whenever this occurs. Advantageously the adjustable mass flows through each separate nozzle (and thus each separate zone) can also be used to redress heat transfer imbalance issues that might otherwise arise due to changes in feed gas composition over time, or from a change in vertical alignment of the main heat exchanger, such as may occur on a vessel. In other words, the temperature of the evaporated refrigerant stream removed from the shell side at the warm end of the main heat exchanger is maximised by separately adjusting the mass flow of the tube side stream in each zone of the tube bundle as described in greater detail below. Another way to achieve maximum efficiency is to ensure that the exit temperature of the tube side streams for each zone is as uniform as possible. The overarching aim is to match the tube side duty to the shell side duty—even when the shell side duty is imbalanced.

Figure 2:
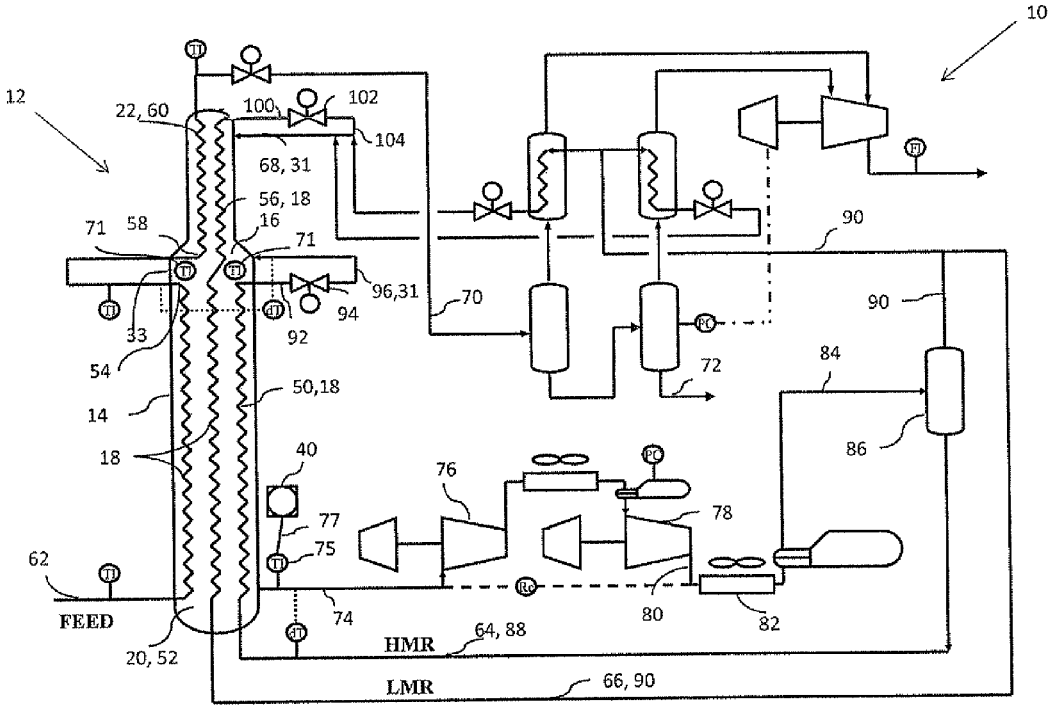
FIG. 2 shows schematically a flow scheme of a plant for liquefying natural gas; and, FIG. 3 shows schematically the distribution of flows to each layer of the main heat exchanger of one embodiment of the present invention.
Figure 3:
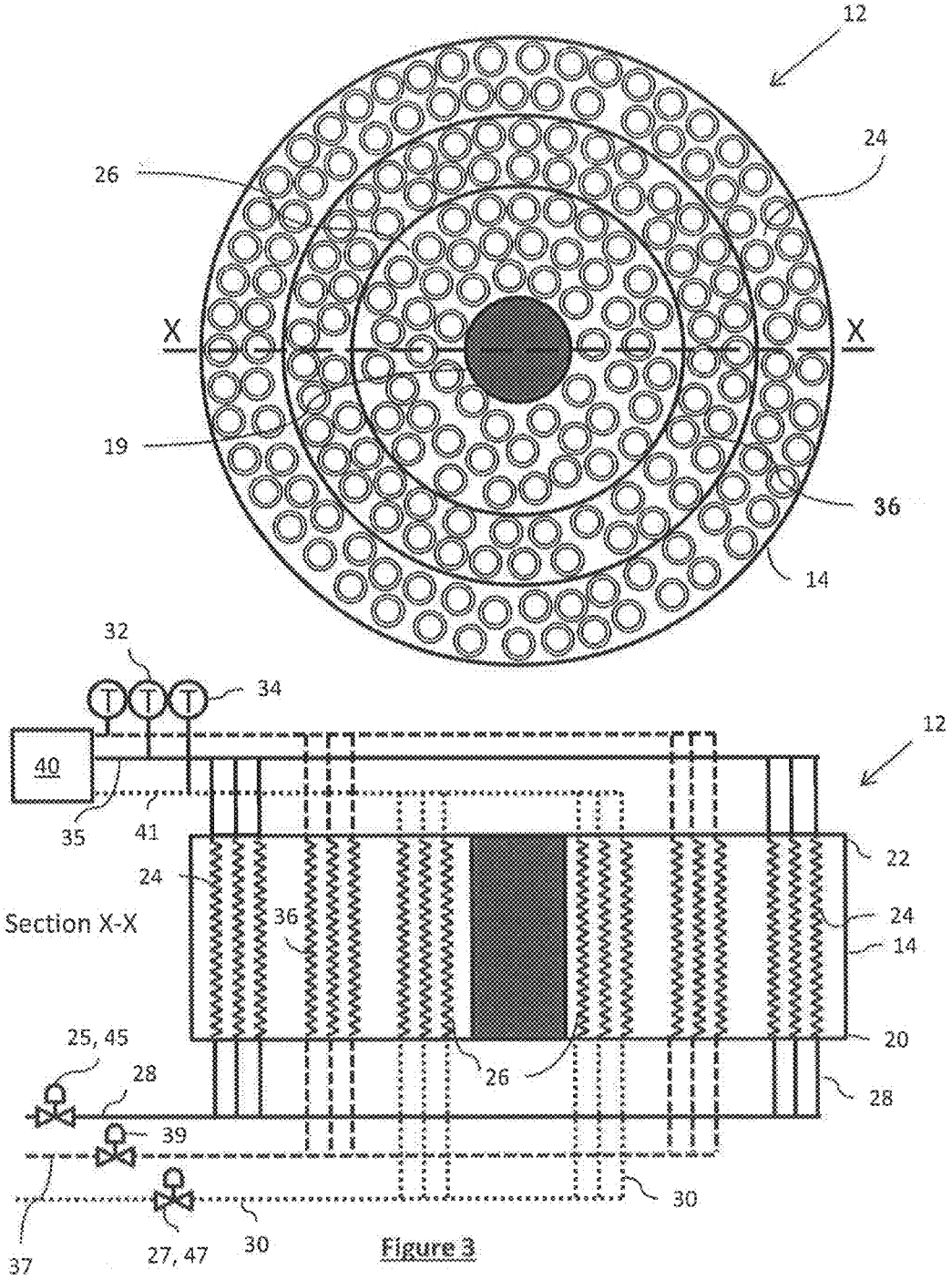

FIGS. 2 and 3 illustrate one embodiment of a process or plant (10) for cooling a tube side stream in a main heat exchanger (12) according to the present invention. The main heat exchanger (12) has a wall (14) defining a shell side (16) within which a coil-wound tube bundle (18) is arranged around a central mandrel (19), the main heat exchanger (12) having a warm end (20) and a cold end (22). A first mass flow (28) of a tube side stream is supplied to the warm end (20) of a first zone (24) via a first nozzle (25). A second mass flow (30) of a tube side stream is supplied to the warm end (20) of a second zone (26) via a second nozzle (27). The second zone (26) is offset from the first zone (24) a radius extending from the central mandrel (19) to the wall (14) of the main heat exchanger (12). In the embodiment illustrated in FIG. 3, the tube bundle (18) further includes an optional third intermediate zone (36) arranged between the first zone (24) and the second zone (26), said third zone (36) being supplied with a third mass flow (37) of the tube side stream by the third nozzle (39). It is to be understood that any number of zones may be used provided only that supply to each zone is controlled by separate nozzles. It is to be further understood that within each zone, the individual tubes remain evenly distributed and may be arranged in a plurality of layers.

With reference to FIGS. 2 and 3, a single or mixed refrigerant stream (31) is introduced at the cold end (22) of the main heat exchanger and evaporated on the shell side (16) to provide cooling to the first and second mass flows (28 and 30, respectively) of the tube side stream. An evaporated refrigerant stream (74) is removed from the warm end (20) of the main heat exchanger (12). The first mass flow (28) which flows only through the first zone (24) is separately adjusted relative to the second mass flow (30) which flows only through the second zone (26) to maximise the temperature of the evaporated refrigerant stream (74) removed from the warm end (20) of the main heat exchanger (12).

In one embodiment of the present invention, the temperature of the evaporated refrigerant stream (74) removed from the warm end (20) of the main heat exchanger (12) is maximised by equalising the temperature of the first mass flow (28) as measured at a first axial location (33) relative to the length of the mandrel (19) with the temperature of the second mass flow (30) as measured at said first axial location (33).

The mass flow supplied by one or both of the first and second nozzles (25 and 27, respectively) is adjusted in this way to ensure that the temperature of said tube side stream in the first zone (24) is matched to the temperature of said tube side stream in the second zone (26) at any give axial location along the length of the tube bundle (18). While, by way of example, it would be ideal for the exit temperature of the first mass flow (28) to be equal to the exit temperature of the second mass flow (30) at the cold end (22) for maximum efficiency, the term "equalise" is used throughout this specification and the appended claims to refer to incremental adjustment of at least one of the first and second mass flows (28 and 30, respectively) to achieve the result that the exit temperature of the first mass flow (28) more closely approaches the exit temperature of the second mass flow (30) at the cold end (22).

In the embodiment illustrated in FIG. 3, the temperature of the first mass flow (28) is measured using a first temperature sensor (32) with the temperature of the second mass flow (30) being measured using a second temperature sensor (34). With reference to FIG. 2, the temperature of the evaporated refrigerant stream (74) removed from the warm end (20) of the main heat exchanger (12) is measured using a third temperature sensor (75).

For the purposes of automation of one embodiment of the process, a first signal (35) indicative of the temperature measured by the first temperature sensor (32) is compared with a second signal (41) indicative of the temperature measured by the second temperature sensor (34) using a controller (40). The controller (40) is then used to adjust the mass flow supplied to the first zone (24) by the first nozzle (25) separately relative to the mass flow supplied to the second zone (26) via the second nozzle (27) so as to equalize the first and second signals (35 and 41). Alternatively or additionally, a third signal (77) indicative of the temperature measured by the third temperature sensor (75) is provided to the controller (40). The controller (40) is then used to adjust the mass flow supplied to the first zone (24) by the first nozzle (25) relative to the mass flow supplied to the second zone (26) via the second nozzle (27) so as to maximize the temperature of the evaporated refrigerant stream (74). When the tube bundle (18) further includes an optional third intermediate zone (36), the controller (40) may receive a fourth signal indicative of the temperature in the third intermediate zone in an analogous manner to allow adjustment of the third mass flow (37) supplied via the third nozzle (39).

It is to be understood that the total mass flow into the main heat exchanger (12) is controlled either upstream or downstream of the main heat exchanger (12). Consequently, an adjustment made by controller (40) to any of the nozzles (25, 27 or 39) will change the relative mass flow through the other nozzles (25, 27 or 39) whilst the overall mass flow through the main heat exchanger remains constant.

In the embodiment illustrated in FIG. 3, each nozzle is provided with a flow valve, for example a low pressure butterfly valve, located either at the inlet or outlet of the tube side stream (either upstream or downstream of the cold end of the tube bundle) to facilitate adjustment of the mass flow through that nozzle. Thus, the mass flow through the first nozzle (25) is controllably adjusted using a first valve (45) while the mass flow through the second nozzle (27) is controllably adjusted using a second valve (47). Advantageously, when one or both of the first and second valves (45 and 47, respectively) are external to the main heat exchanger, adjustment of the mass flow rate through the first and second nozzles (25 and 27, respectively) can occur without having to take the main heat exchanger offline, thus avoiding the disruptive loss of production associated with shutdowns.

Reference is now made to FIG. 2 which illustrates schematically a plant (10) for liquefying a gaseous, methane-rich feed gas in the form of natural gas in a main heat exchanger (12). In this embodiment, the wall (14) of the main heat exchanger (12) defines a shell side (16) within which is arranged two tube bundles, being a warm tube bundle (50) having a warm end (52) and a cold end (54) and a cold tube bundle (56) having a warm end (58) and a cold end (60). The warm tube bundle (50) is arranged towards the warm end (20) of the main heat exchanger (12) and the cold tube bundle (56) is arranged towards the cold end (22) of the main heat exchanger (12). In the embodiment illustrated in FIG. 2, the tube bundle is arranged to received a first tube side stream (62), a second tube side stream (64), and a third tube side stream (66) as described in greater detail below. However, the present invention applies equally to main heat exchanger operating with only one or two tube side streams provided only that a first mass flow of any given tube side stream is directed to flow through a first subset of individual tubes and a second mass flow of said tube side stream is directed to flow through a second subset of individual tubes, with each of the first and second subsets of individual tubes being radially offset across the coil-wound tube bundle.

In the embodiment illustrated in FIG. 2, the first tube side stream (62) enters the warm tube bundle (50) at elevated pressure as a gaseous, methane-rich feed which has been liquefied and partially sub-cooled by the time it passes from the cold end (54) of the warm tube bundle (50) into the warm end (58) of the cold tube bundle (56). The first tube side stream (62) enters the warm end (58) of the cold tube bundle (56) as a partially sub-cooled liquid and exits the cold end (60) of the cold tube bundle (56) as a further sub-cooled liquid. As it passes through the cold tube bundle (56), the first tube side stream (62) exchanges heat with a predominately liquid light refrigerant stream (68) which is progressively boiled off on the shell side (16) of the cold tube bundle (56). The resulting sub-cooled liquefied first tube side stream (70) is removed from the cold end (22) of the main heat exchanger (12) before being directed to storage (72).

An evaporated mixed refrigerant stream (74) removed from the shell side (16) at the warm end (20) of the main heat exchanger (12) is fed to first and second refrigerant compressors (76 and 78) in which the evaporated refrigerant stream (74) is compressed to form a high pressure refrigerant stream (80). The high pressure refrigerant stream (80) is then directed to one or more heat exchangers (82) in which it is cooled so as to produce a partly-condensed mixed refrigerant stream (84) which is then directed in a separator (86) to separate out a heavy refrigerant fraction in liquid form (88) and a light refrigerant fraction in gaseous form (90). The heavy refrigerant fraction (88) becomes the second tube side stream (64) which enters at the warm end (52) of the warm tube bundle (50) as a liquid and exits at the cold end (54) of the warm tube bundle (50) as a sub-cooled heavy refrigerant stream (92). In this way, the heavy refrigerant second tube side stream remains a liquid at all times as it passes through the warm tube bundle of the main heat exchanger.

The sub-cooled heavy refrigerant stream (92) removed at the cold end (54) of the warm tube bundle (50) is expanded across a first expansion device (94), for example a Joule-Thompson valve ("J-T valve"), to form a reduced pressure heavy refrigerant stream (96) that is then introduced into the shell side (16) of the main heat exchanger (12) at a location intermediate between the cold end (54) of the warm tube bundle (50) and the warm end (58) of the cold tube bundle (56). The reduced pressure heavy refrigerant stream (96) is thus one of the refrigerant streams (31) that is allowed to evaporate in the shell side (16), thereby cooling the fluids in the first, second and third tube side streams (62, 64 and 66, respectively) as they pass through the warm tube bundle (50).

Part of the light refrigerant fraction (90) from the separator (86) becomes the third tube side stream (66) which is introduced into the warm end (52) of the warm tube bundle (50) as a gas and exits at the cold end (60) of the cold tube bundle (56) as a sub-cooled liquid light refrigerant stream (100). More specifically, the third tube side stream (66) is cooled from a gas to a liquid and partially sub-cooled as it passes through the warm tube bundle (50) and is further cooled to a sub-cooled liquid as it passes through the cool bundle (56). The sub-cooled light refrigerant stream (100) removed from the cold end (22) of the main heat exchanger (12) is expanded through a second expansion device (102), for example a J-T valve to cause a reduction in pressure and produce a reduced pressure light refrigerant stream (104). The reduced pressure light refrigerant stream (104) is thus another of the refrigerant streams (31) introduced into the shell side (16) of the main heat exchanger (12). In this case, the reduced pressure light refrigerant stream (104) starts to evaporate in the shell side (16) to provide cooling to the cold tube bundle (56), thereby cooling the fluids in the first and third tube side streams (62 and 66, respectively) as they travel through the cold tube bundle (56) as well as providing cooling to the fluids in the first, second and third tube side streams (62, 64 and 66, respectively) as they travel through the warm tube bundle (50).

When the process and apparatus of the present invention is used for liquefaction of a gaseous methane-rich feed to obtain a liquefied natural gas, the tube side stream can be one or more of: the first tube side stream; the second tube side stream; or, the third tube side stream. The selection of which tube side stream(s) require rebalancing will depend on the size of the temperature differentials measured for different zones across the cold end of the tube bundle at the tube side stream exits.

By way of example, the temperature of a first tube side stream exiting a first zone at the cold end of the tube bundle may be compared with the temperature of the first tube side stream exiting a second zone of the cold end of the tube bundle. In this example, the mass flow of the first tube side stream into the warm end of the tube bundle is rebalanced until the temperature of the first tube side stream exiting the first zone at the cold end of the tube bundle moves closer to the temperature of the first tube side stream exiting the second zone at the cold end of the tube bundle. If the temperature of the first tube side stream exiting the first zone at the cold end of the tube bundle is higher than the temperature of the first tube side stream exiting the second zone at the cold end of the tube bundle, the step of rebalancing of the mass flow is achieved by restricting the flow of the first tube side stream to the first zone at the warm end of the tube bundle. In this way, the mass flow of the first tube side stream to the second zone at the warm end of the tube bundle is essentially increased as the overall mass flow rate of the first tube side stream into the warm end of the tube bundle does not change.

Analogously, by way of further example, the temperature of the second tube side stream exiting a first zone at the cold end of the warm tube bundle may be compared with the temperature of the second tube side stream exiting a second zone at the cold end of the warm tube bundle. In this example, the mass flow of the second tube side stream into the warm end of the warm tube bundle is rebalanced until the temperature of the second tube side stream exiting the first zone at the cold end of the warm tube bundle moves closer to being equal to the temperature of the second tube side stream exiting the second zone at the cold end of the warm tube bundle. If the temperature of the second tube side stream exiting the first zone at the cold end of the warm tube bundle is lower than the temperature of the second tube side stream exiting the second zone at the cold end of the warm tube bundle, the step of rebalancing of the mass flow is achieved by restricting the flow of the second tube side stream to the second zone at the warm end of the warm tube bundle. In this way, the mass flow of the second tube side stream to the first zone at the warm end of the warm tube bundle is essentially increased as the overall mass flow rate of the second tube side stream into the warm end of the warm tube bundle does not change.

Restriction of the mass flow of a tube side stream to any given zone within the bundle can be achieved by adjusting the mass flows through the nozzle or valve responsible for directing the mass flow of that side stream to said zone. It is considered a matter of routine for a person skilled in the art to determine the degree to which flow through a nozzle needs to be adjusted for any given zone of the tube bundle to compensate for the difference in temperature of said tube side stream exiting the cold end of the tube bundle for said zone. This can be achieved using modelling techniques well known in the art.

Now that embodiments of the invention have been described in detail, it will be apparent to persons skilled in the relevant art that numerous variations and modifications can be made without departing from the basic inventive concepts. For example, a plurality of shell side temperature sensors (71) may be used to provide a corresponding plurality of signals indicative of the temperature of each zone within the tube bundle. This plurality of signals may be fed to the controller (40) to facilitate controlled adjustment of the mass flow of a tube side stream to said zones. All such modifications and variations are considered to be within the scope of the present invention, the nature of which is to be determined from the foregoing description and the appended claims.

Any patents cited in this specification, are herein incorporated by reference. It will be clearly understood that, although a number of prior art publications are referred to herein, this reference does not constitute an admission that any of these documents forms part of the common general knowledge in the art, in Australia or in any other country. In the summary of the invention, the description and claims which follow, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

What is claimed is:

1. A main heat exchanger for liquefying a tube side stream, the main heat exchanger having a warm end and a cold end in use, the main heat exchanger comprising:

a wall defining a shell side within which is arranged a coil-wound tube bundle arranged around a central mandrel;

a first nozzle for supplying a first mass flow of a tube side stream into the tubes of a first zone of individual tubes in said tube bundle at the warm end of said first zone of individual tubes;

a second nozzle for supplying a second mass flow of said tube side stream into the tubes of a second zone of individual tubes in said tube bundle at the warm end of said second zone of individual tubes, the second zone of individual tubes being offset from the first zone of individual tubes along a radius extending from said central mandrel to said wall of said main heat exchanger;

a distributor for supplying a refrigerant stream on said shell side for cooling the first and second mass flows to form an evaporated refrigerant stream;

a line for removing the evaporated refrigerant stream from the warm end of said main heat exchanger;

a first temperature sensor which generates a first signal indicative of the temperature of the first mass flow;

a second temperature sensor which generates a second signal indicative of the temperature of the second mass flow; and a controller for equalizing the temperature of the first mass flow of the tube side stream at a first axial location with the temperature of the second mass flow of the tube side stream at said first axial location by comparing the first signal indicative of the temperature of the first mass flow with the second signal indicative of the temperature of the second mass flow and adjusting the first mass flow of the tube side stream supplied by said first nozzle relative to the second mass flow of the tube side stream supplied by said second nozzle to equalize the first signal with the second signal.

2. The main heat exchanger of claim 1, wherein said first axial location is at or adjacent to the cold end of said main heat exchanger.

3. The main heat exchanger of claim 1, wherein said first zone of individual tubes is an inner zone of said tube bundle and said second zone of individual tubes is an outer zone of said tube bundle.

4. The main heat exchanger of claim 1, wherein the mass flow through said first nozzle is controllably adjusted using a first valve and the mass flow through said second nozzle is controllably adjusted using a second valve.

5. The main heat exchanger of claim 4, wherein one or both of said first and second valves is external to said main heat exchanger.

6. The main heat exchanger of claim 4, wherein one or both of said first and second valves is a fail-safe open valve.

7. The main heat exchanger of claim 4, wherein one or both of said first and second valves are located at the warm end of the tube side stream.

8. The main heat exchanger of claim 1, wherein said first nozzle supplies the tube side stream to said first zone of individual tubes via a first tube sheet and said second nozzle supplies the tube side stream to said second zone of individual tubes via a second tube sheet.

9. The main heat exchanger of claim 1, wherein said tube bundle comprises a warm tube bundle arranged towards the warm end of said main heat exchanger, and a cold tube bundle arranged towards the cold end of said main heat exchanger, each of said warm tube bundle and said cold tube bundle having a warm end and a cold end and said first axial location is at or adjacent to the cold end of said warm tube bundle.

10. The main heat exchanger of claim 4, wherein one or both of said first and second valves is located at one or both of the warm end and the cold end of the tube side stream.

11. A main heat exchanger for liquefying a tube side stream, the main heat exchanger having a warm end and a cold end in use, the main heat exchanger comprising:

a wall defining a shell side within which is arranged a coil-wound tube bundle arranged around a central mandrel;

a first nozzle for supplying a first mass flow of a tube side stream into the warm end of a first zone of individual tubes in said tube bundle;

a second nozzle for supplying a second mass flow of said tube side stream into the warm end of a second zone of individual tubes in said tube bundle, the second zone of individual tubes being offset from the first zone of individual tubes along a radius extending from said central mandrel to said wall of said main heat exchanger;

a distributor for supplying a refrigerant stream on said shell side for cooling the first and second mass flows to form an evaporated refrigerant stream;

a line for removing the evaporated refrigerant stream from the warm end of said main heat exchanger;

a first temperature sensor which generates a first signal indicative of the temperature of the first mass flow;

a second temperature sensor which generates a second signal indicative of the temperature of the second mass flow; and a controller for equalizing the temperature of the first mass flow of the tube side stream at a first axial location with the temperature of the second mass flow of the tube side stream at said first axial location by comparing the first signal indicative of the temperature of the first mass flow with the second signal indicative of the temperature of the second mass flow and adjusting the first mass flow of the tube side stream supplied by said first nozzle relative to the second mass flow of the tube side stream supplied by said second nozzle to equalize the first signal with the second signal to improve the efficiency of said main heat exchanger.

12. The main heat exchanger of claim 1, wherein the overall mass flow of said tube side stream through said heat exchanger remains constant.

13. The main heat exchanger of claim 9, wherein one of the tube side streams flowing through said warm tube bundle is a liquid refrigerant stream which enters the tubes of said warm tube bundle at the warm end of said warm tube bundle, exits the tubes of said warm tube bundle at the cold end of said warm tube bundle as a sub-cooled liquid refrigerant, is expanded and then introduced into the shell of said heat exchanger at a point between the cold end of said warm tube bundle and the warm end of said cold tube bundle.

14. The main heat exchanger of claim 9, wherein one of the tube side streams flowing through said warm tube bundle is a refrigerant stream which enters the tubes of said warm tube bundle as a gas at the warm end of said warm tube bundle, exits the tubes of said cold tube bundle at the cold end of said warm tube bundle as a sub-cooled liquid refrigerant, is expanded and then introduced into the shell of said heat exchanger at a point near the cold end of said cold tube bundle.

15. A process for cooling a tube side stream in the main heat exchanger of claim 1 having a warm end and a cold end comprising:

a) supplying a first mass flow of a tube side stream into the warm end of said first zone of individual tubes in said tube bundle via said first nozzle;

b) supplying a second mass flow of the tube side stream into the warm end of said second zone of individual tubes in said tube bundle via said second nozzle;

c) supplying a refrigerant stream on the shell side via said distributor for cooling said first and second mass flows to form an evaporated refrigerant stream;

d) removing said evaporated refrigerant stream from the warm end of the main heat exchanger; and e) adjusting said first mass flow of the tube side stream supplied by said first nozzle relative to said second mass flow of the tube side stream supplied by said second nozzle to equalize the first signal with the second signal.

16. The process of claim 15, wherein said first axial location is at or adjacent to the cold end of said main heat exchanger.

17. The process of claim 15, wherein the first zone of individual tubes is an inner zone of said tube bundle and the second zone of individual tubes is an outer zone of said tube bundle.

18. The process of claim 15, wherein the mass flow through said first nozzle is controllably adjusted using a first valve and the mass flow through said second nozzle is controllably adjusted using a second valve.

19. The process of claim 18, wherein one or both of said first and second valves are external to said main heat exchanger.

20. The process of claim 18, wherein one or both of said first and second valves is a fail-safe open valve.

21. The process of claim 18, wherein one or both of said first and second valves is located at one or both of the warm end of the tube side stream.

22. The process of claim 15, wherein said first nozzle supplies the tube side stream to said first zone of individual tubes via a first tube sheet and said second nozzle supplies the tube side stream to said second zone of individual tubes via a second tube sheet.

23. The process of claim 15, wherein said tube bundle comprises a warm tube bundle arranged towards the warm end of said main heat exchanger, and a cold tube bundle arranged towards the cold end of said main heat exchanger, each of said warm tube bundle and said cold tube bundle having a warm end and a cold end and said first axial location is at or adjacent to the cold end of said warm tube bundle.

24. The process of claim 23, wherein the tube side stream is a first tube side stream which enters the warm end of said warm tube bundle as a liquid and exits the cold end of said cold tube bundle as a sub-cooled liquid.

25. The process of claim 24, wherein the first tube side stream enters the warm end of said warm tube bundle as a gaseous, methane-rich feed which becomes liquefied by the time first tube side stream passes from the warm end of said warm tube bundle into the warm end of said cold tube bundle.

26. The process of claim 25, wherein the first tube side stream enters the warm end of said cold tube bundle as a liquid and exits the cold end of the cold tube bundle as a sub-cooled liquid.

27. The process of claim 26, wherein the sub-cooled liquid is removed from the cold end of said cold tube bundle of said main heat exchanger before being directed to storage.

28. The process of claim 27, wherein the first tube side stream exchanges heat with a refrigerant stream which is progressively boiled off on said shell side of said cold tube bundle.

29. The process of claim 28, wherein evaporated refrigerant removed from the warm end of said shell side of said main heat exchanger is fed to first and second refrigerant compressors in which the evaporated refrigerant is compressed to form a high pressure refrigerant stream.

30. The process of claim 29, wherein the high pressure refrigerant stream is directed to a heat exchanger in which high pressure refrigerant stream is cooled so as to produce a partly-condensed refrigerant stream which is then sent to a separator wherein a heavy refrigerant fraction in liquid form and a light refrigerant fraction in gaseous form are separated.

31. The process of claim 30, wherein the heavy refrigerant fraction becomes a second tube side stream which is supplied at the warm end of said warm tube bundle as a liquid and exits at the cold end of said warm tube bundle as a sub-cooled heavy refrigerant stream in liquid form.

32. The process of claim 31, wherein the sub-cooled heavy refrigerant stream removed at the cold end of said warm tube bundle is expanded across a first expansion device to form a reduced pressure heavy refrigerant stream that is then introduced into said shell side of said main heat exchanger at a location intermediate between the cold end of said warm tube bundle and the warm end of said cold tube bundle, and wherein said reduced pressure heavy refrigerant stream is allowed to evaporate in said shell side, thereby cooling the fluids in the first and second side streams as they pass through the warm tube bundle.

33. The process of claim 32, wherein part of the light refrigerant fraction from said separator becomes a third tube side stream which is introduced into the warm end of the warm tube bundle as a gas and exits at the cold end of the cold tube bundle as a sub-cooled liquid.

34. The process of claim 33, wherein the third tube side stream is cooled from a gas to a liquid as the third tube side stream passes through said warm tube bundle and the third tube side stream is cooled from a liquid to a sub-cooled liquid as the third tube side stream passes through said cool tube bundle.

35. The process of claim 34, wherein the sub-cooled light refrigerant stream removed from the cold end of said cold tube bundle is expanded through a second expansion device to cause a reduction in pressure and produce a reduced pressure light refrigerant stream.

36. The process of claim 35, wherein the reduced pressure light refrigerant stream is introduced into said shell side of said main heat exchanger at its cold end, and wherein said reduced pressure light refrigerant stream is allowed to evaporate in said shell side, thereby cooling the fluids in the first and third tube side streams as they travel through said cold tube bundle, as well as providing cooling to the fluids in the first, second and third tube side streams as they travel through said warm tube bundle.

* * * * *